US010478736B1

(12) United States Patent
McNeill

(10) Patent No.: US 10,478,736 B1
(45) Date of Patent: Nov. 19, 2019

(54) CHILD'S SWING SEAT WITH COVER

(71) Applicant: Shade Swing, LLC, Dallas, TX (US)

(72) Inventor: Martin Chad McNeill, Dallas, TX (US)

(73) Assignee: Shade Swing, LLC, Dallas, TX (US)

( * ) Notice: Subject to any disclaimer, the term of this patent is extended or adjusted under 35 U.S.C. 154(b) by 0 days.

(21) Appl. No.: 16/012,915

(22) Filed: Jun. 20, 2018

(51) Int. Cl.

| | |
|---|---|
| ***A63G 9/00*** | (2006.01) |
| ***A47D 15/00*** | (2006.01) |
| ***A47D 13/10*** | (2006.01) |
| *A47D 13/00* | (2006.01) |

(52) U.S. Cl.
CPC ..... *A63G 9/00* (2013.01); *A47D 13/107* (2013.01); *A47D 15/006* (2013.01)

(58) Field of Classification Search
CPC ... A63G 9/00; A63G 9/12; A47D 1/00; A47D 1/10; A47D 13/00; A47D 13/105; E04H 15/00; E04H 15/58
USPC ..... 472/118–119; 297/184.13, 184.15, 297/184.17, 256.15, 467; 135/90, 96, 117
See application file for complete search history.

(56) References Cited

U.S. PATENT DOCUMENTS

| | | | |
|---|---|---|---|
| 2,912,044 | A | 11/1959 | David |
| 3,528,657 | A | 9/1970 | Krupsky |
| D272,171 | S | 1/1984 | Lankford |
| D282,970 | S | 3/1986 | Parkin |
| 4,693,512 | A | 9/1987 | Hobson |
| D297,685 | S | 9/1988 | Wilson |
| D315,644 | S | 3/1991 | White |
| 5,203,363 | A | 4/1993 | Kidwell et al. |
| 5,334,099 | A | 8/1994 | Marra et al. |
| D375,423 | S | 11/1996 | Lapointe |
| 6,416,132 | B1 | 7/2002 | Norton et al. |
| 7,175,535 | B1 | 2/2007 | Marmentini |
| 7,565,910 | B2 | 7/2009 | Alexakis |
| D601,358 | S | 10/2009 | Yu |
| 7,806,472 | B2 | 10/2010 | Runk et al. |
| D655,518 | S | 3/2012 | Sclare |
| 8,439,447 | B2 | 5/2013 | Brown et al. |
| 8,678,942 | B2 | 3/2014 | Zhang |
| D751,307 | S | 3/2016 | Pena |
| D772,587 | S | 11/2016 | Micol |

(Continued)

FOREIGN PATENT DOCUMENTS

| | | | |
|---|---|---|---|
| DE | 19841035 | A1 | 3/1999 |
| GB | 2508369 | A | 6/2014 |
| WO | WO 2016166553 | A1 | 10/2016 |

OTHER PUBLICATIONS

"High Back Infant Swing," Gorilla Playsets, gorillaplaysets.com, accessed: Sep. 2017. http://gorillaplaysets.com/high-back-infant-swing/.

(Continued)

*Primary Examiner* — Kien T Nguyen
(74) *Attorney, Agent, or Firm* — John A. Thomas

(57) ABSTRACT

A child's swing seat has a bottom support and a back support integral with the bottom support. A cover removably connected to the back support is provided. A child restraint is provided, which is fixed in some embodiments and moveable about a hinge in others. In other embodiments, the cover is fixed and integral with the back support. The cover may be dome-shaped or substantially flat. A drain hole is provided in the seat bottom to dispose of rainwater.

16 Claims, 16 Drawing Sheets

(56) References Cited

U.S. PATENT DOCUMENTS

| | | | | |
|---|---|---|---|---|
| 9,533,231 | B2 | 1/2017 | Peres et al. | |
| 2011/0181078 | A1* | 7/2011 | Kelly | A47C 4/286 297/16.1 |

OTHER PUBLICATIONS

"Infant to Toddler Swing™," Step 2, step2.com, Jul. 12, 2017. https://web.archive.org/web/20170712035137/https://www.step2.com/p/infant-totoddler-swing.

"Outdoor Sun Safe Swing Canopy Infant Baby Shade Seat Toddler Bouncer Play Set," Amazon, amazon.com, ASIN: B014TB6THS, accessed: Sep. 2017. https://www.amazon.com/Outdoor-Canopy-Infant-Toddler-Bouncer/dp/B014TB6THS.

* cited by examiner

CHILD'S SWING SEAT WITH COVER

BACKGROUND

Technical Field

This disclosure relates to child seats, in particular to child seats for playground swings.

Background

The hazards associated with sun exposure are well documented. Still, outdoor play and childhood are synonymous. Youngsters, more than adults, risk the detrimental effects of the sun's ultraviolet ("UV") rays. Children have more skin relative to their body mass. The outer layer of their skin is thinner and more sensitive than an adult's, making painful sunburns more damaging to a child. Many youngsters spend a significant amount of time out-doors. One activity children have enjoyed for centuries is swinging on a swing. Moreover, swings have been developed so that youngsters of all ages can enjoy playing on a swing. Parents often learn that the harmonic and constant motion of a swing is soothing for many infants, helping them to settle down or get ready for a nap or sleep. Conventionally, such swing seats provide some sort of forward restraint for the child's body, which restraint may be fixed or moveable.

Although a child swinging out of doors for an extended period of time may need protection from the sun, if the exposure is not lengthy, or the activity is in other environments, such as shaded areas or indoor gyms, such protection may not be necessary. It would be advantageous of a swing seat could both provide sun protection, and at the same time adaptable to allow the child to experience a full range of vision and the enjoyment of freely moving through the air.

DRAWINGS

Non-limiting embodiments of the present disclosure are described by way of example in the following drawings, which are schematic and are not intended to be drawn to scale:

DETAILED DESCRIPTION

Figure 1:
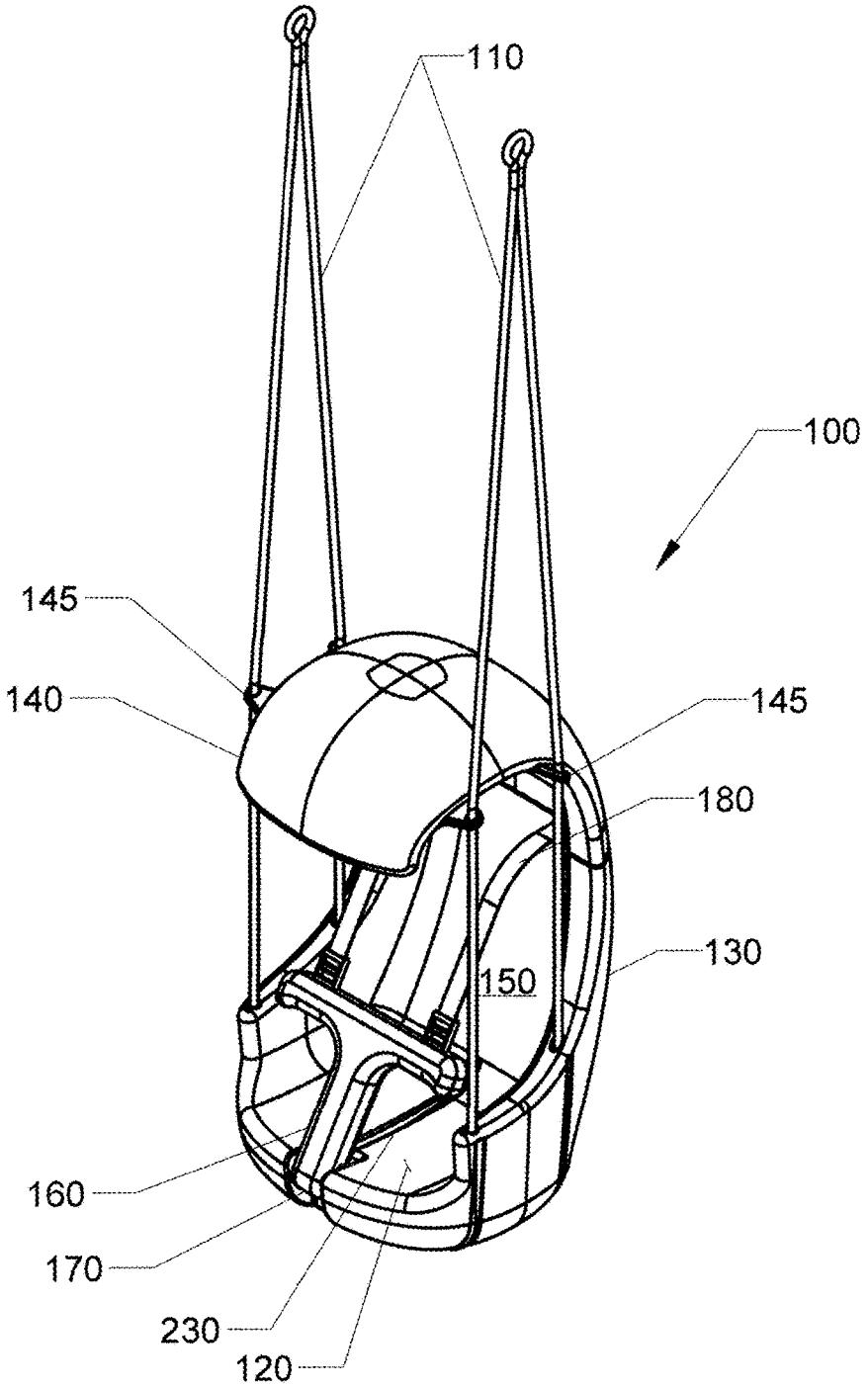
FIG. 1 shows an embodiment of the child swing seat having a domed cover, the domed cover separable from the body of the seat, and a moveable child restraint.
Figure 2:
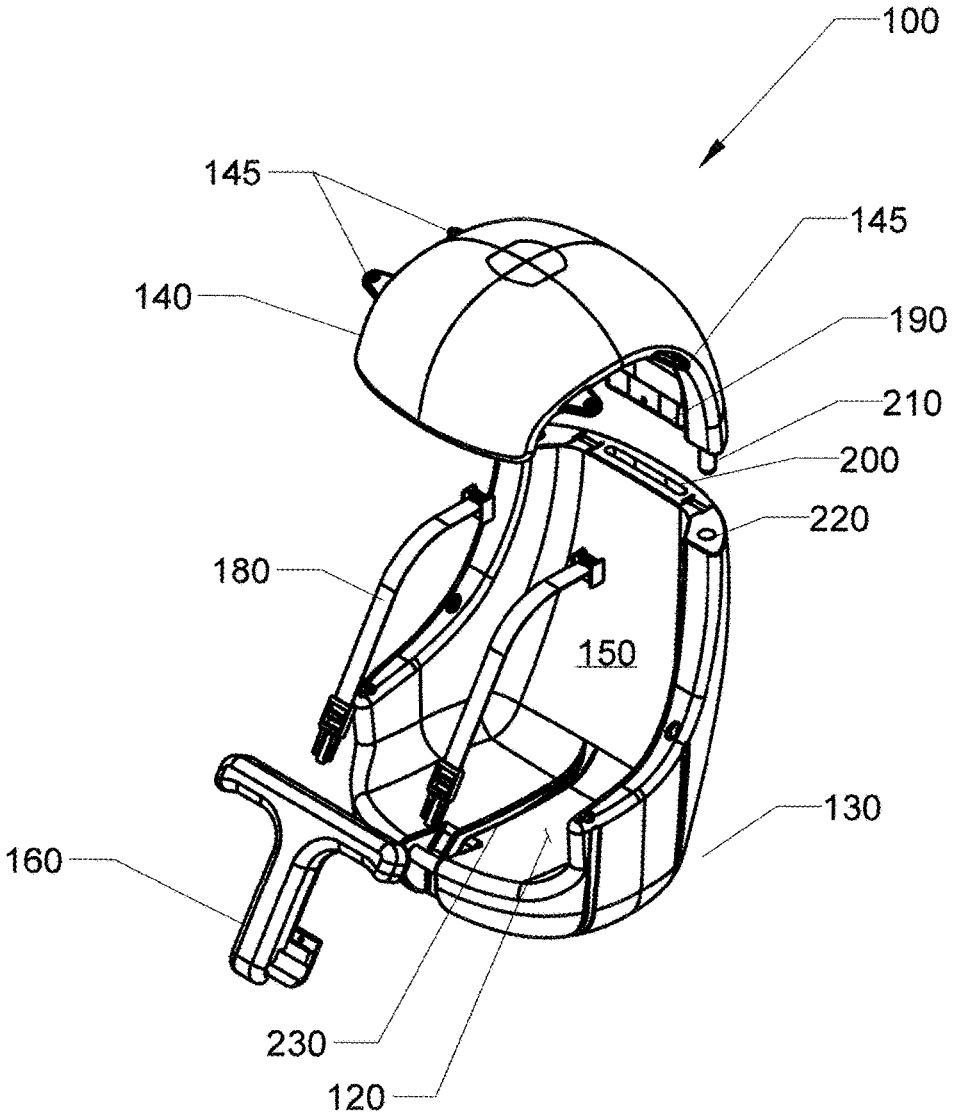
FIG. 2 is an exploded view of the embodiment of FIG. 1.

A first embodiment of the subject child swing seat 100 is illustrated in FIGS. 1 and 2. FIG. 1 shows the child swing seat 100 as it would be in practice suspended by ropes or wires 110. The swing seat 100 has a bottom support 120 for supporting the body of a child (i.e., the buttocks and thighs of the child), a back portion 130, and a cover 140. In this embodiment, the cover 140 has a rounded or domed shape. The seat 100 has a back support 150, which back support 150 supports the cover 140. In this and other embodiments, the preferred material for construction of the child swing seat 100 would be a molded plastic, but the child swing seat could be formed of other material as well. The ropes or wires 110 supporting the swing seat 100 preferably pass through guides 145 affixed to the cover 140 to maintain stability.

The embodiment of FIGS. 1 and 2 shows a moveable child restraint bar 160, which restraint bar 160 moves on a hinge 170 to swing outward to allow a child to be placed on the bottom support 120 and then moved inwardly toward the child to lock into place and safely restrain the child. The child swing seat 100 preferably has adjustable restraining straps 180 configured to pass over a child's shoulders.

As shown in FIG. 2, the cover 140 in this embodiment is conveniently separable from the back portion 130 of the child swing seat 100. This allows free air flow about the child, which may be more enjoyable for the child, and acceptable particularly when sunlight is not present or bright. As shown in FIG. 2, the separable cover 140 engages the back portion 130 by means of one or more plug-and-socket mechanisms. Shown in FIG. 2 is a plug 190, having an oblong cross-section, protruding from the cover 140, which oblong plug 190 mates with a corresponding socket 200 formed in the body of the seat back portion 130. Further provided in FIG. 2 is a peg 210 protruding from the cover 140, which peg 210 engages a hole 220 in the back portion 130. The plug 190 and the peg 210 should be sized with the respective socket 200 or hole 220 so as to provide secure engagement between the cover 140 and the back portion 130, according to the material from which these parts are constructed, such as by an interference fit.

FIGS. 1 and 2 and other figures show an optional hole or groove 230 in the bottom support 120 to facilitate drainage of rainwater when the child swing seat 100 is left out of doors.

Figure 3:
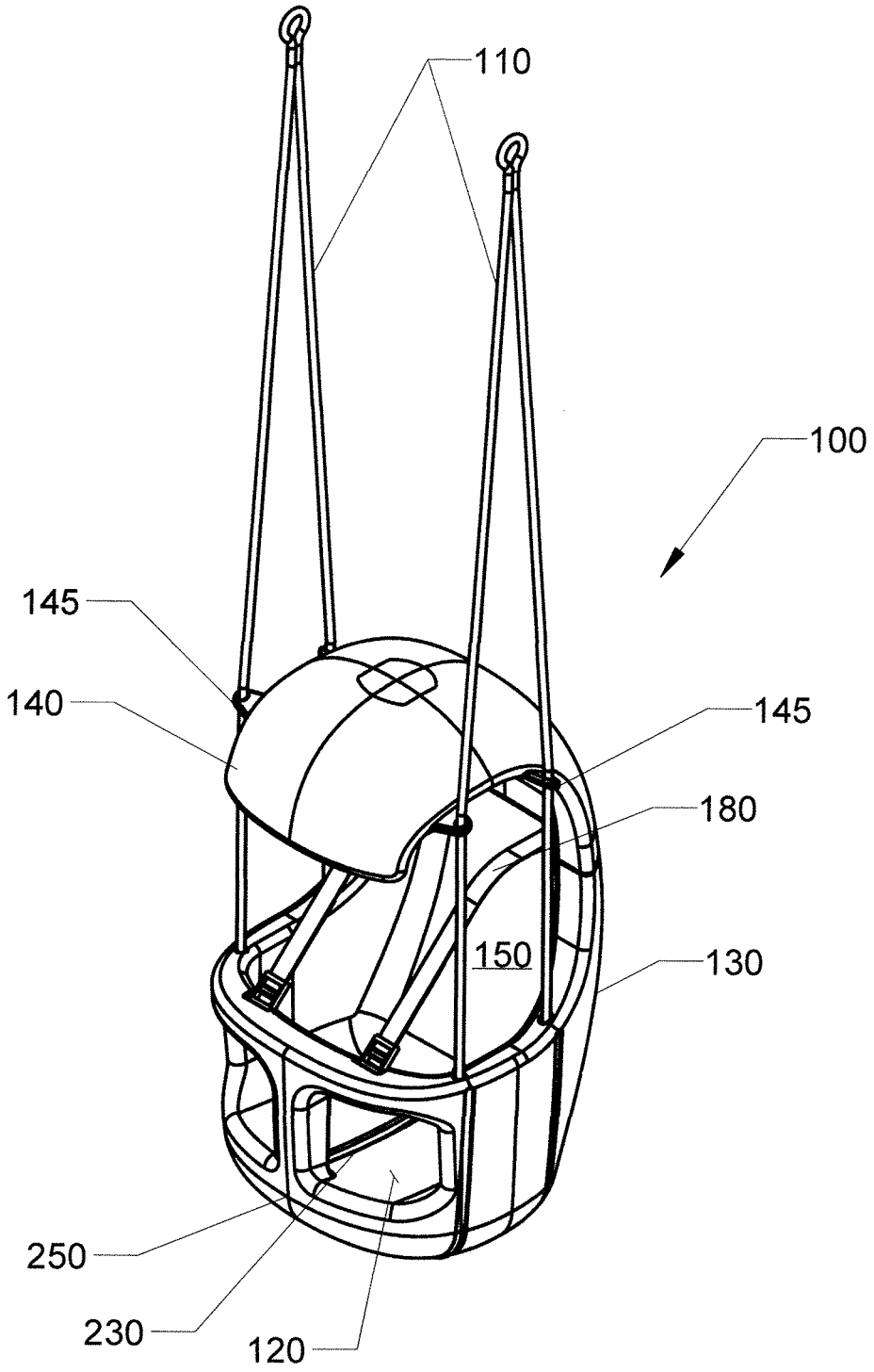
FIG. 3 shows an embodiment of the child swing seat having a domed cover, the domed cover separable from the body of the seat, and a fixed child restraint.
Figure 4:
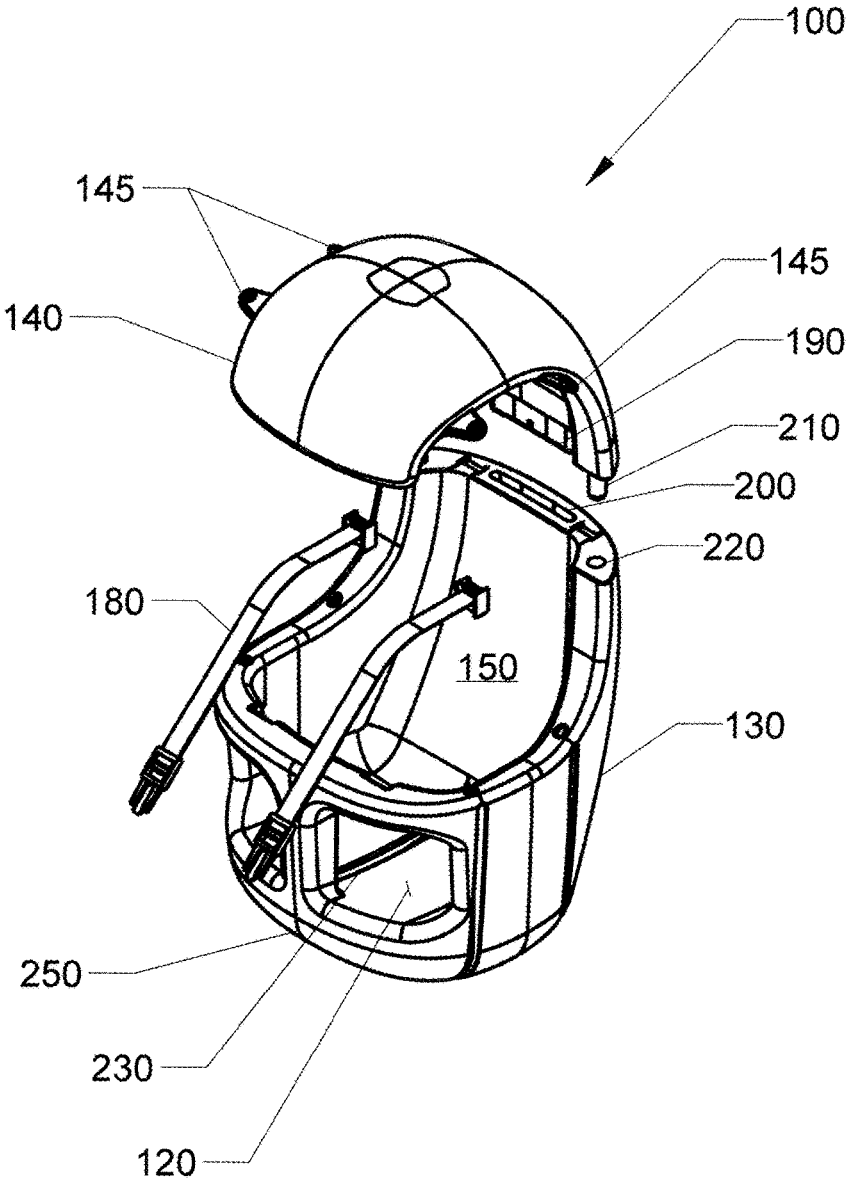
FIG. 4 is an exploded view of the embodiment of FIG. 3.

A second embodiment is shown in FIGS. 3 and 4, where the child swing seat 100, as described above, has a domed cover 140, the domed cover 140 separable from the back portion 130 of the seat 100, but has a fixed child restraint 240, shown as preferably integral with the back portion 130 and the bottom support 120.

Figure 5:
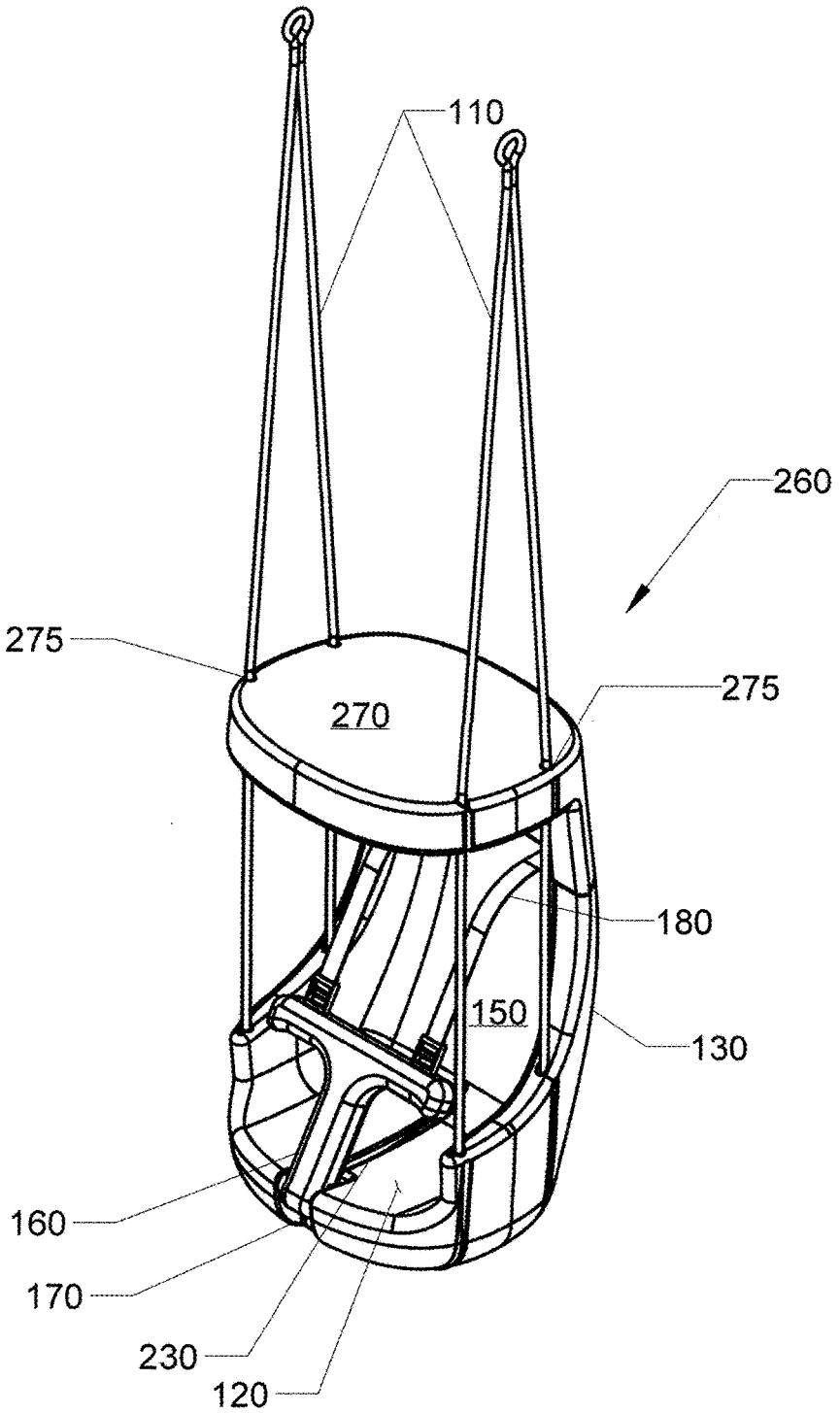
FIG. 5 shows an embodiment of the child swing seat having a substantially flat cover, the flat cover separable from the body of the seat, and a moveable child restraint.
Figure 6:
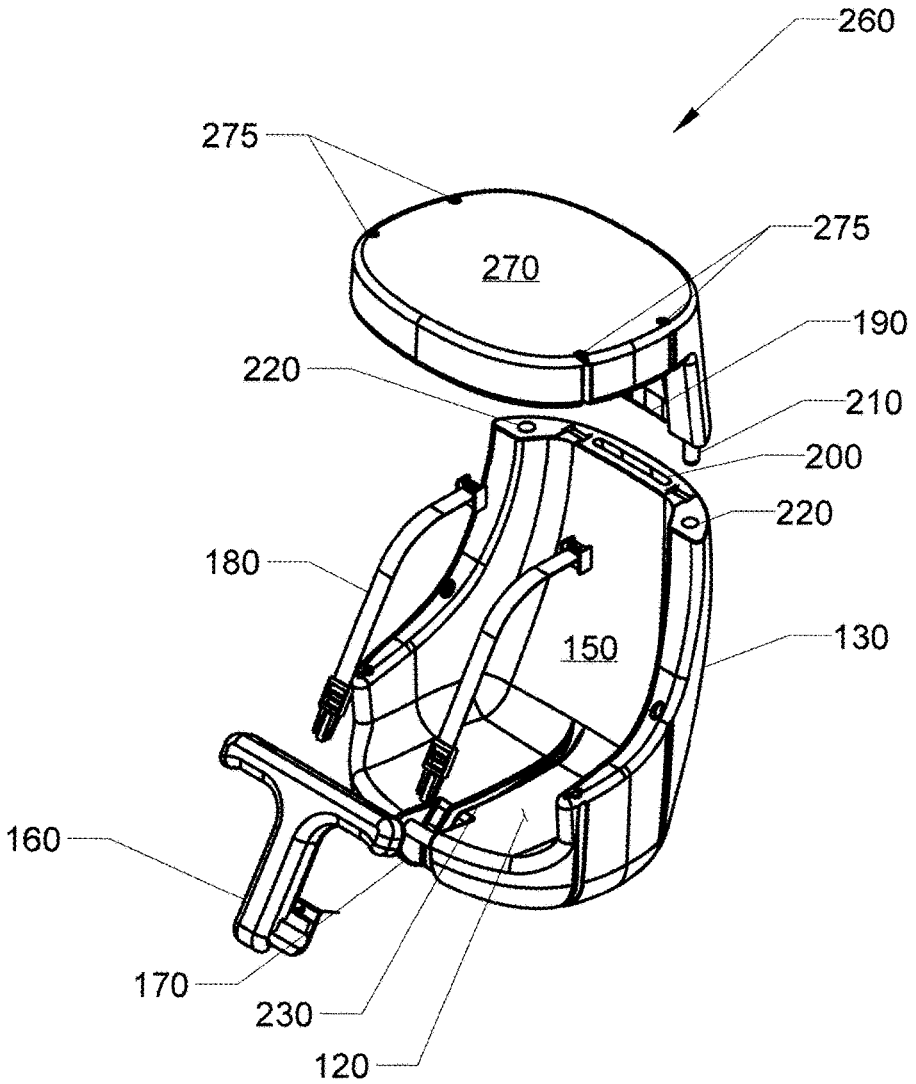
FIG. 6 is an exploded view of the embodiment of FIG. 5.

A third embodiment is shown in FIGS. 5 and 6, where the child swing seat 260 has a substantially flat cover 270, the flat cover 270 separable from the back portion 130 of the seat 100, and a moveable child restraint 160, as previously described. In this embodiment and others with the flat cover 270, the ropes or wires 110 supporting the swing seat 260 pass through holes 275 in the flat cover.

Figure 7:
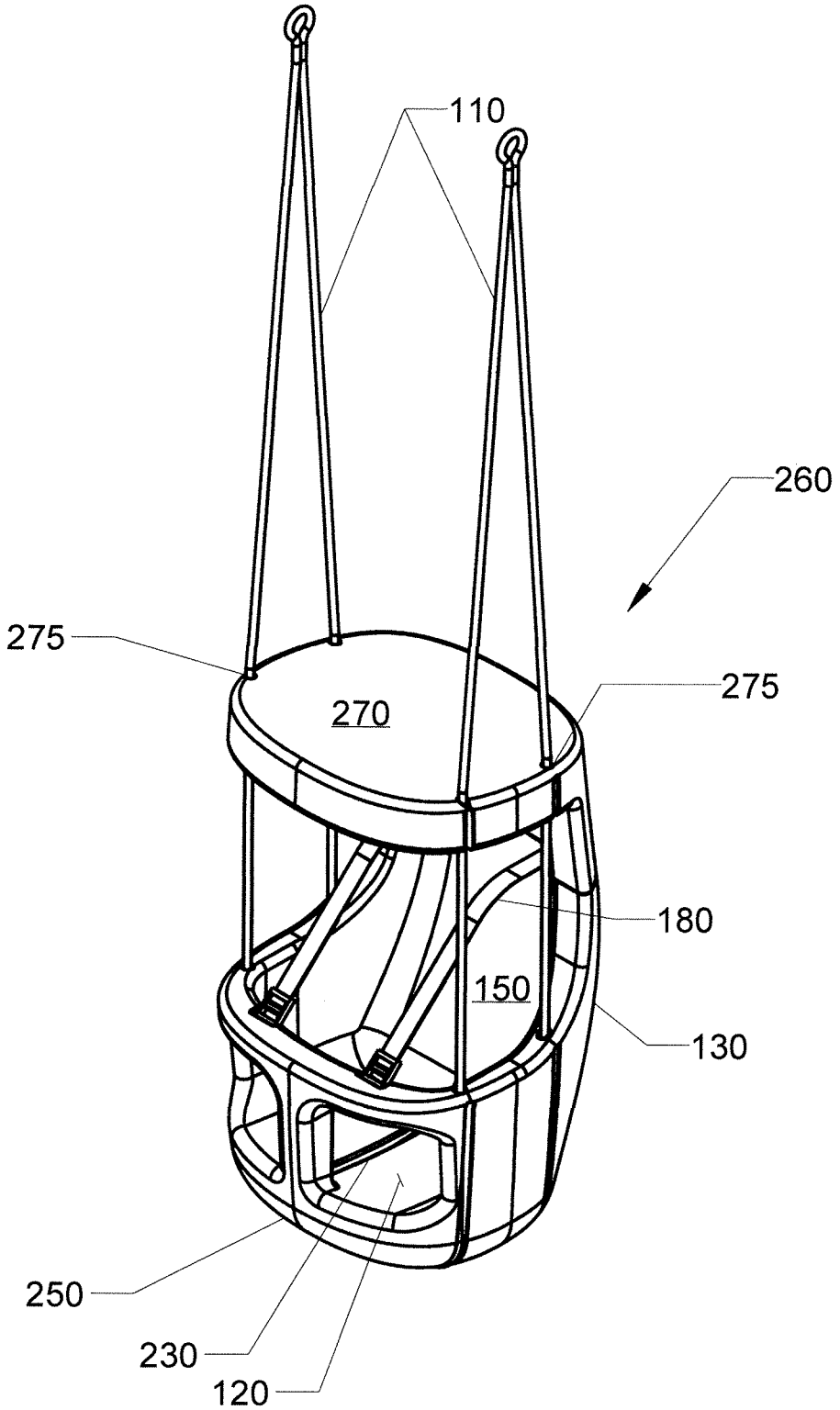
FIG. 7 shows an embodiment of the child swing seat having a substantially flat cover, the flat cover separable from the body of the seat, and a fixed child restraint.
Figure 8:
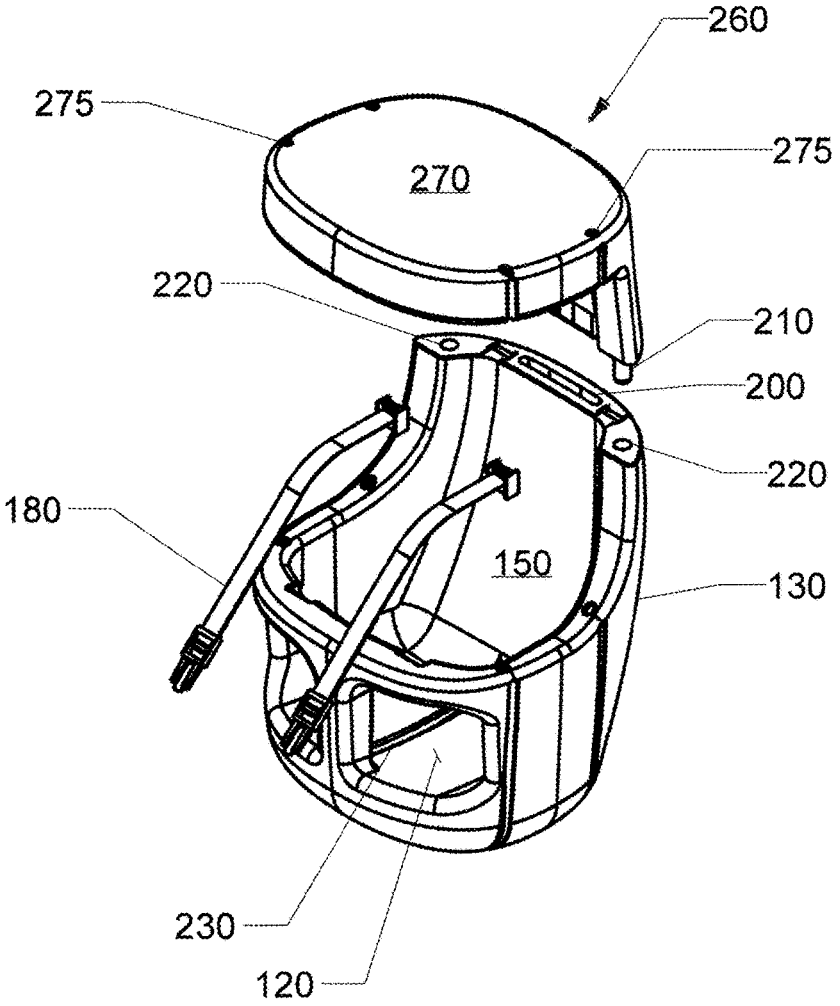
FIG. 8 is an exploded view of the embodiment of FIG. 7

A fourth embodiment is shown in FIGS. 7 and 8, where the child swing seat 100 has a substantially flat cover 270, the flat cover 270 separable from the back portion 130 of the seat 100, and a fixed child restraint 240, as previously shown.

Figure 9:
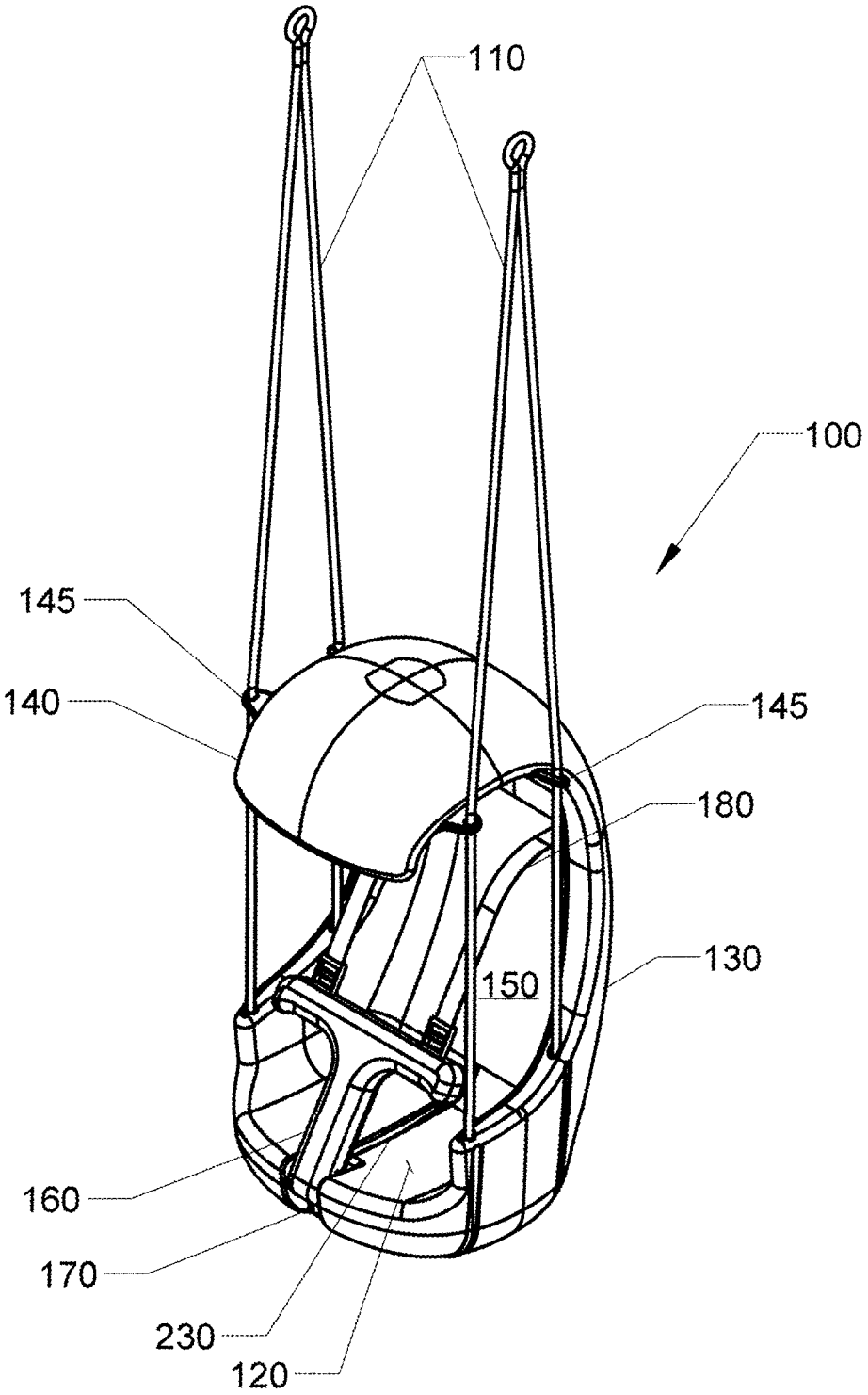
FIG. 9 shows an embodiment of the child swing seat having a domed cover, the domed cover fixed with the body of the seat, and a moveable child restraint.
Figure 10:
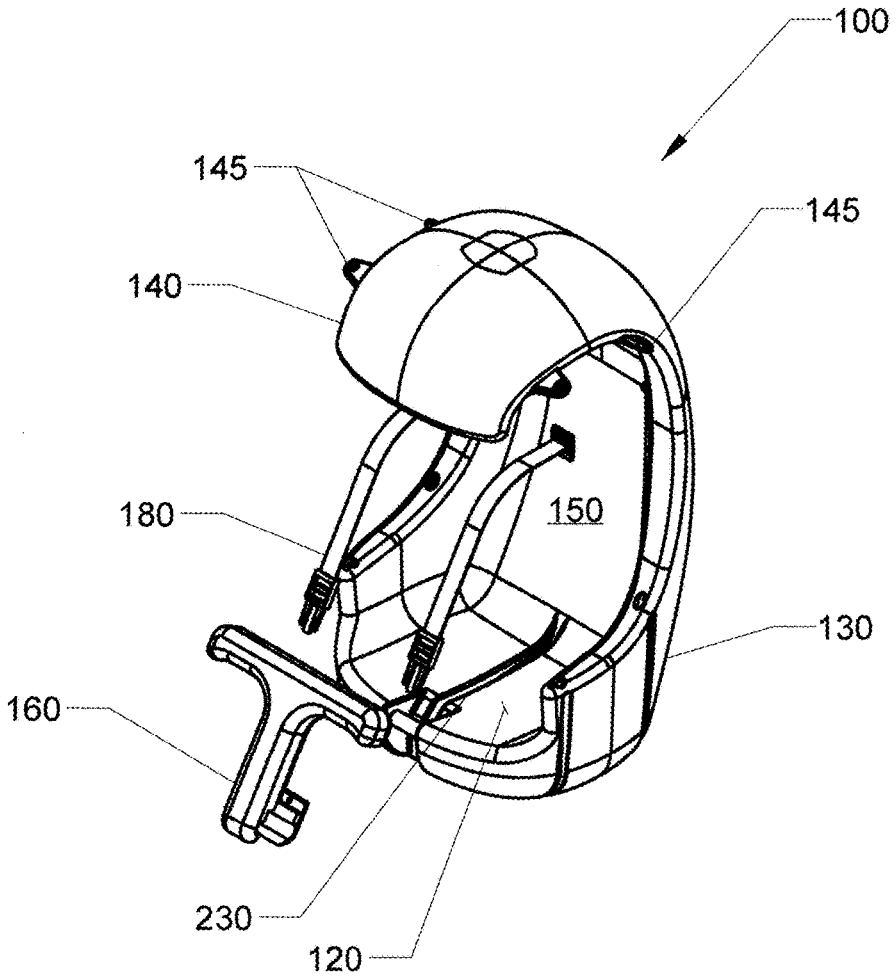
FIG. 10 is an exploded view of the embodiment of FIG. 9.

A fifth embodiment is shown in FIGS. 9 and 10, where the child swing seat 100 has a domed cover 140, and the domed cover 140 is fixed to or formed integrally with the back portion 130 and not separable from it, and where the embodiment further includes a moveable child restraint 160, as previously described.

Figure 11:
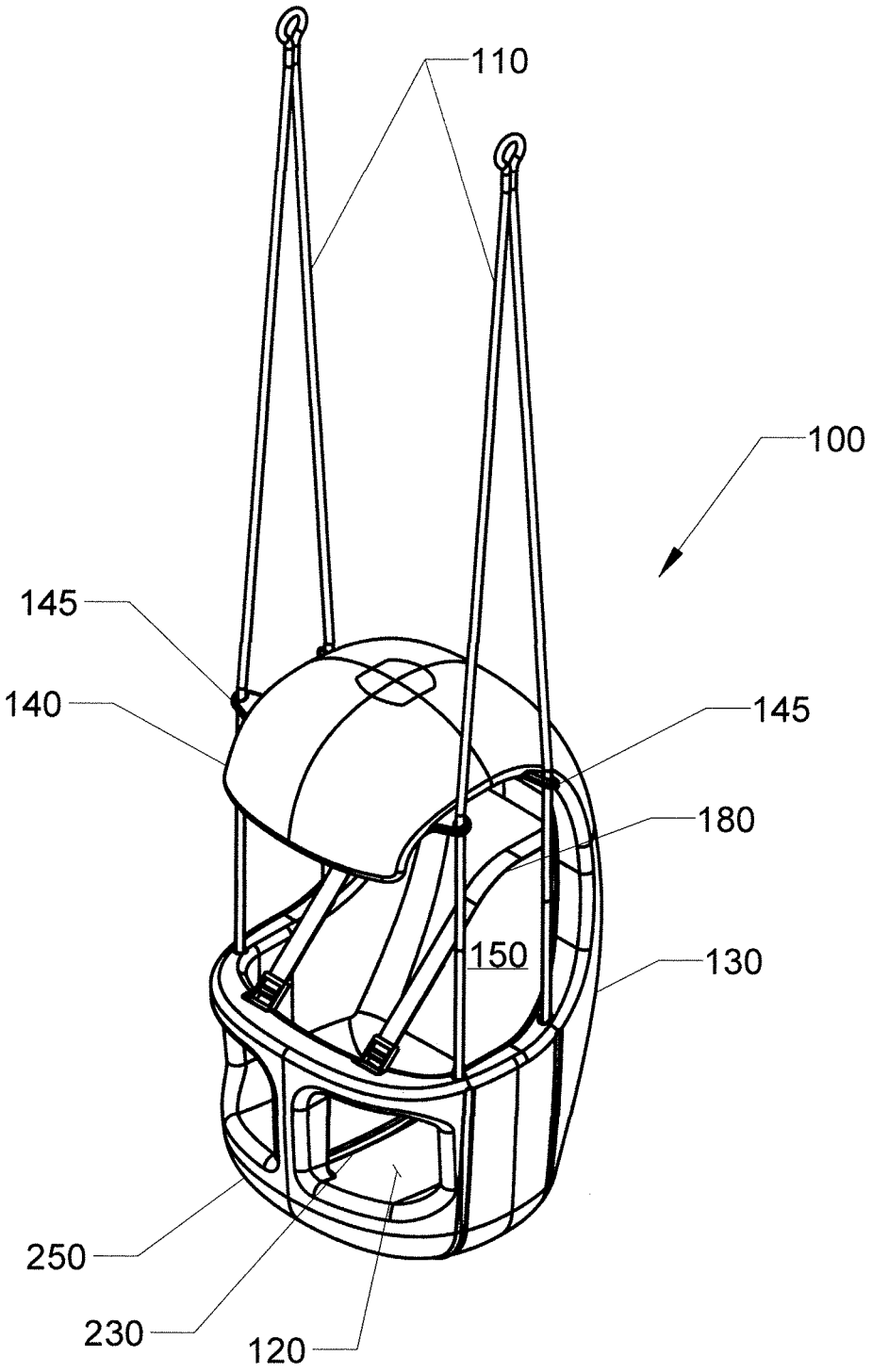
FIG. 11 shows an embodiment of the child swing seat having a domed cover, the domed cover fixed with the body of the seat, and a fixed child restraint.
Figure 12:
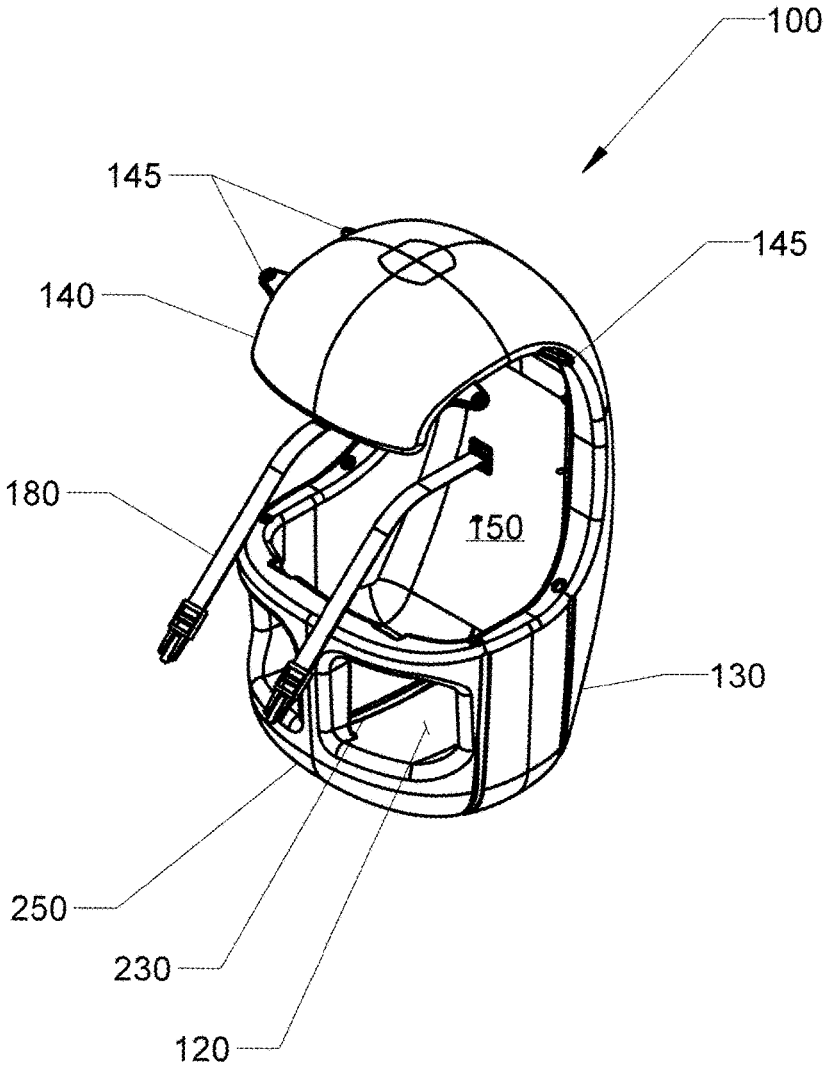
FIG. 12 is an exploded view of the embodiment of FIG. 11.

A sixth embodiment is shown in FIGS. 11 and 12, where the child swing seat 100 has a domed cover 140, and the domed cover 140 is fixed to or formed integral with the back portion 130 and not separable from it, and where the embodiment further includes a fixed child restraint 240, as previously described.

Figure 13:
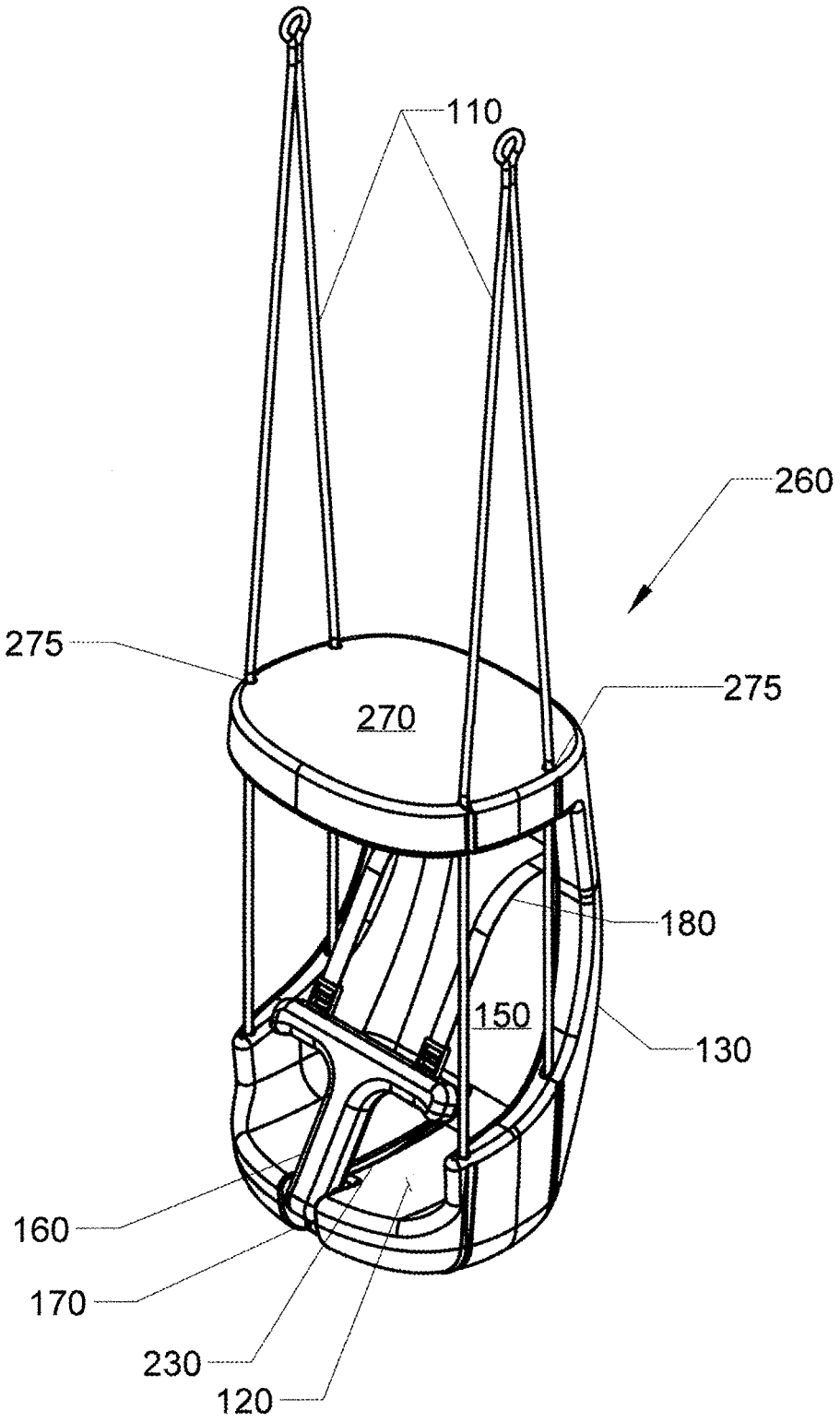
FIG. 13 shows an embodiment of the child swing seat having a substantially flat cover, the flat cover fixed with the body of the seat, and a moveable child restraint.
Figure 14:
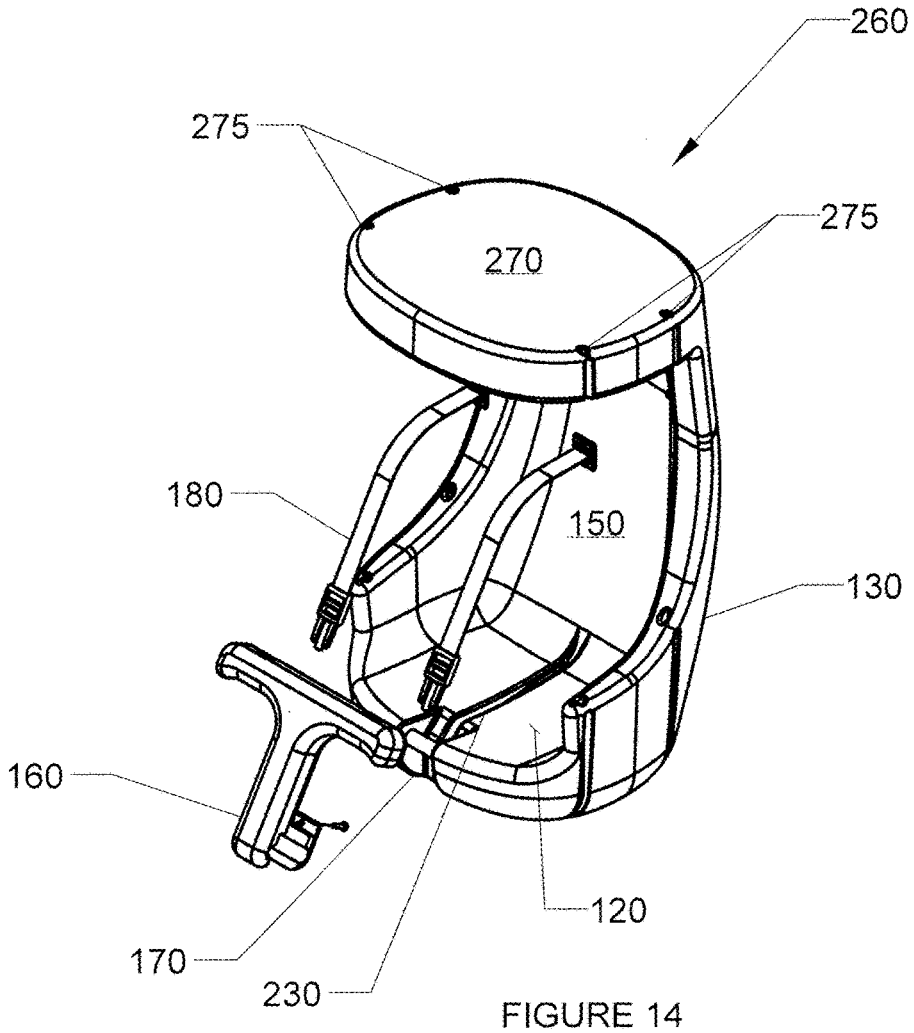
FIG. 14 is an exploded view of the embodiment of FIG. 13.

A seventh embodiment is shown in FIGS. 13 and 14, where child swing seat 260 has a substantially flat cover 270, the flat cover 270 fixed to or formed integral with the back portion 130 of the seat 260, and a moveable child restraint 160, as previously described.

Figure 15:
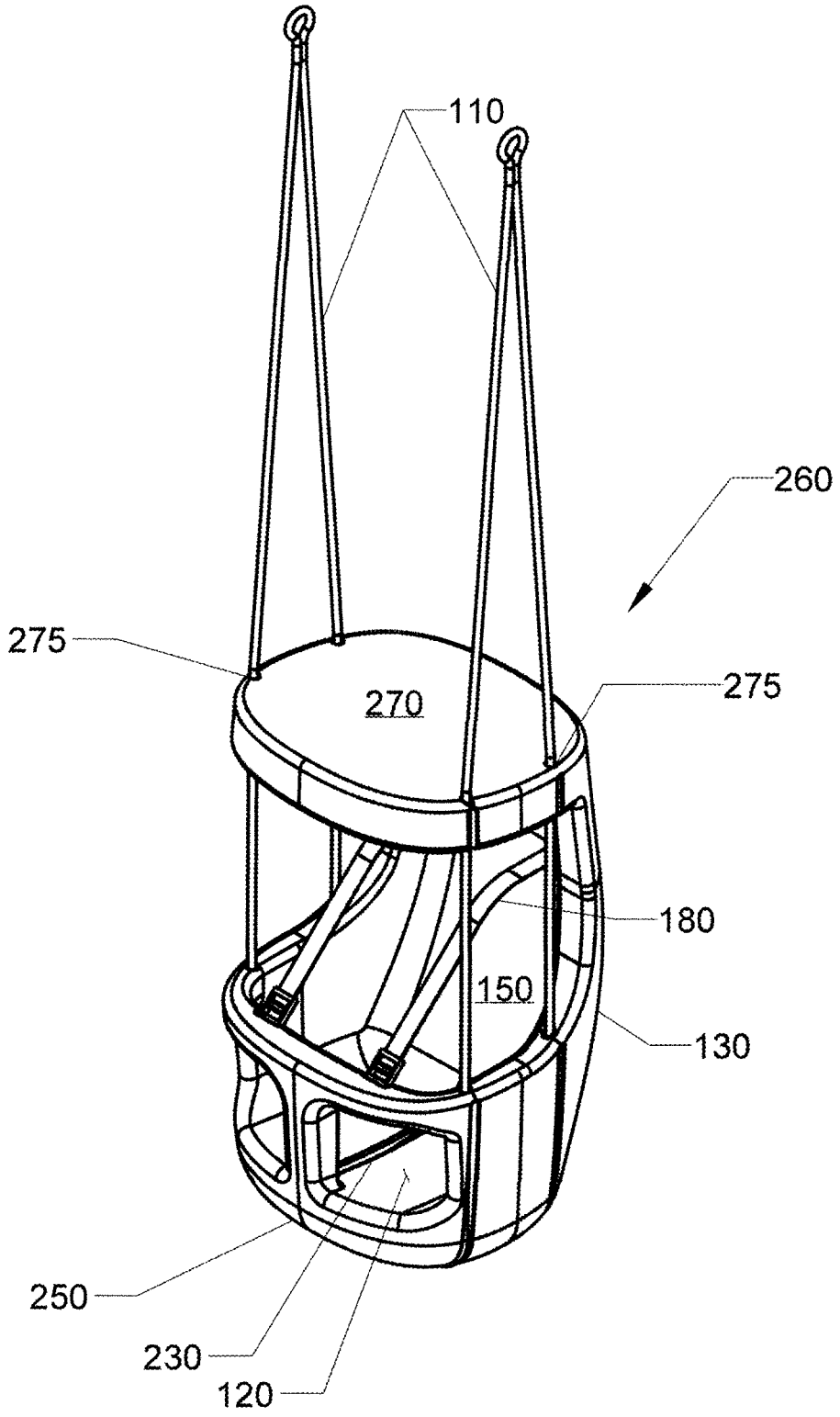
FIG. 15 shows an embodiment of the child swing seat having a substantially flat cover, the flat cover fixed with the body of the seat, and a fixed child restraint.
Figure 16:
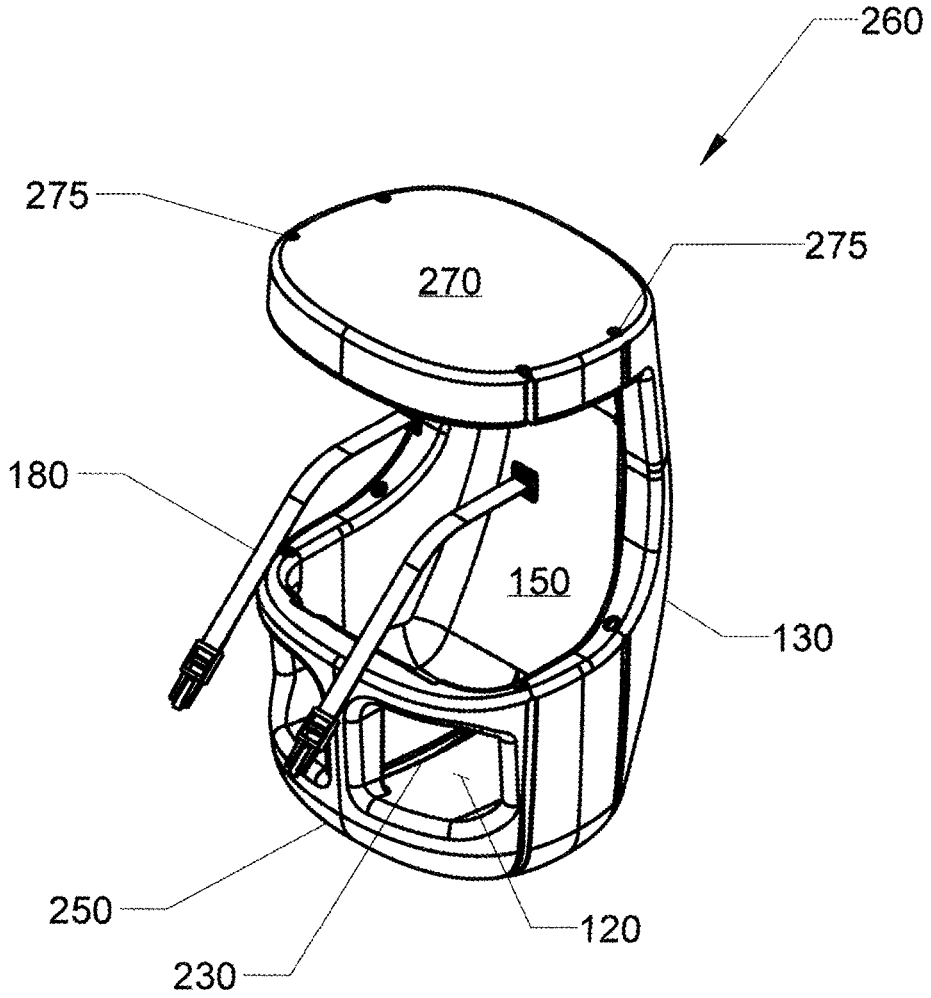
FIG. 16 is an exploded view of the embodiment of FIG. 15.

An eighth embodiment is shown in FIGS. 15 and 16, where the child swing seat 260 has a substantially flat cover 270, the flat cover 270 fixed to or formed integral with the back portion 130 of the seat 260, and a fixed child restraint 240, as previously described.

None of the description in this application should be read as implying that any particular element, step, or function is an essential element which must be included in the claim scope; the scope of patented subject matter is defined only by the allowed claims. Moreover, none of these claims are intended to invoke 35 U.S.C. Section 112(f) unless the exact words "means for" are used, followed by a gerund. The claims as filed are intended to be as comprehensive as possible, and no subject matter is intentionally relinquished, dedicated, or abandoned.

I claim:

1. A child's swing seat, comprising:

a bottom support;

a back support; the back support integral with the bottom support;

a solid and rigid removable cover; the removable cover removably connected to the back support where the removable cover further comprises at least one oblong plug; and the back support further comprises a receptacle for engaging the at least one oblong plug; and, where the removable cover further comprises first and second pegs, and the back support further comprises first and second holes for engaging the first and second pegs, respectively; and, where the first and second pegs and the first and second holes are located on either side of the oblong plug and the receptacle for engaging the oblong plug, respectively; and, a moveable child restraint; the moveable child restraint further comprising a hinge; the hinge connecting the moveable child restraint to the bottom support.

2. The child's swing seat of claim 1, further comprising a rope for supporting the child's swing seat.

3. The child's swing seat of claim 2, where the removable cover further comprises guides for the rope supporting the child's swing seat.

4. The child's swing seat of claim 1, further comprising restraint straps releasably connected to the back support and to the moveable child restraint.

5. The child's swing seat of claim 1, where the removable cover has a dome shape.

6. The child's swing seat of claim 1, further comprising a drainage hole in the bottom support.

7. The child's swing seat of claim 1, where the cover has a substantially flat shape.

8. A child's swing seat, comprising:

a bottom support;

a back support; the back support integral with the bottom support;

a solid and rigid removable cover; the removable cover removably connected to the back support where the removable cover further comprises at least one oblong plug; and the back support further comprises a receptacle for engaging the at least one oblong plug; and, where the removable cover further comprises first and second pegs, and the back support further comprises first and second holes for engaging the first and second pegs, respectively; and, where the first and second pegs and the first and second holes are located on either side of the oblong plug and the receptacle for engaging the oblong plug, respectively; and, a fixed child restraint integral with the back support and the bottom support.

9. The child's swing seat of claim 8, where the removable cover further comprises at least one oblong plug, and the back support further comprises a receptacle for engaging the at least one oblong plug.

10. The child's swing seat of claim 9, where the removable cover further comprises at least one peg, and the back support further comprises a hole for engaging the at least one peg.

11. The child's swing seat of claim 8, further comprising a rope for supporting the child's swing seat.

12. The child's swing seat of claim 11, where the removable cover further comprises guides for the rope supporting the child's swing seat.

13. The child's swing seat of claim 8, further comprising restraint straps releasably connected to the back support and to the fixed child restraint.

14. The child's swing seat of claim 8, where the removable cover has a dome shape.

15. The child's swing seat of claim 8, further comprising a drainage hole in the bottom support.

16. The child's swing seat of claim 8, where the removable cover has a substantially flat shape.

* * * * *